US006854206B2

(12) United States Patent
Oz

(10) Patent No.: US 6,854,206 B2
(45) Date of Patent: Feb. 15, 2005

(54) RAIL CONNECTOR AND METHOD

(75) Inventor: David Oz, London (GB)

(73) Assignee: T.D.I. Arms Systems, Ltd., Tel Aviv (IL)

( * ) Notice: Subject to any disclaimer, the term of this patent is extended or adjusted under 35 U.S.C. 154(b) by 0 days.

(21) Appl. No.: 10/668,020

(22) Filed: Sep. 22, 2003

(65) Prior Publication Data

US 2005/0011104 A1 Jan. 20, 2005

(30) Foreign Application Priority Data

Jun. 24, 2003 (IL) ..... 156627

(51) Int. Cl.[7] ..... F41G 1/16

(52) U.S. Cl. ..... 42/124; 42/85; 42/90; 42/111

(58) Field of Search ..... 42/85, 90, 111, 42/124

(56) References Cited

U.S. PATENT DOCUMENTS 4,765,224 A * 8/1988 Morris ..... 89/191.01
4,845,871 A * 7/1989 Swan ..... 42/127
5,198,600 A * 3/1993 E'Nama ..... 42/90
5,343,650 A * 9/1994 Swan ..... 42/117
5,522,166 A * 6/1996 Martel ..... 42/124
5,533,292 A * 7/1996 Swan ..... 42/123
5,590,484 A * 1/1997 Mooney et al. ..... 42/111
5,806,228 A * 9/1998 Martel et al. ..... 42/124
6,134,823 A * 10/2000 Griffin ..... 42/105
6,381,895 B1 * 5/2002 Keeney et al. ..... 42/124
6,418,657 B1 * 7/2002 Brown ..... 42/124
6,499,245 B1 * 12/2002 Swan ..... 42/71.01
6,508,027 B1 * 1/2003 Kim ..... 42/124
6,678,988 B1 * 1/2004 Poff, Jr. ..... 42/147

FOREIGN PATENT DOCUMENTS

DE 20309678 * 9/2003
EP 0003457444 A2 * 12/1989
WO WO/93/20398 * 10/1993

* cited by examiner

*Primary Examiner*—Michael J. Carone
*Assistant Examiner*—John Richardson
(74) *Attorney, Agent, or Firm*—Robert L. Stone

(57) ABSTRACT

A rail connector and method for mounting on a firearm having a front sight, the connector including at least two mounting rails, and a fastening member for securely fastening the connector directly to the front sight of the firearm, the fastening member being coupled to the mounting rails.

16 Claims, 14 Drawing Sheets

RAIL CONNECTOR AND METHOD

FIELD OF THE INVENTION

The present invention relates to a rail connector for a firearm in general and, in particular, to a connector for mounting at least two rails on a rifle.

BACKGROUND OF THE INVENTION

In recent years, the increasing complexity of combat has generated a need for weapons with increased accuracy and which are capable of supporting various accessories, such as flashlights, infrared and night vision scopes, laser spotters, and so forth. Consequently, a wide variety of mounts for rifles and other hand weapons have been developed which permit the mounting of lights, scopes and the like on the weapon, often along the barrel. Such mounts are generally referred to as Modular Weapon Systems, and replace the factory handguards of the host weapon systems.

These modular weapon systems generally include Picatinny or other rails or tracks, often using MIL-STD-1913 for standardization of the mounting systems, and are affixed to the barrel or stock of the rifle for mounting accessories thereon. A variety of designs have been suggested for such modular weapon systems and such rails, as well as differing numbers of rails which can be coupled at one time to a rifle. At present, it is known to mount up to four rails about the handguard of a rifle.

Since the rails are generally mounted on the handguard (or handguard replacement) of the rifle, accessories mounted thereon must be zeroed often, since the alignment of the accessory relative to the barrel changes slightly during firing of the weapon or if the weapon receives a shock (i.e., falls).

Recently floating rails have been suggested. These include rails attached to a weapon in such a way as not to contact the barrel. These generally are attached at the rear of the rifle only, in order to attempt to provide more stability over times However, these rails, also, suffer from alignment problems due to the shock created by the gases during firing. In addition, most of these rails can be mounted only by an armorer, by taking apart the barrel and sight and reassembling the weapon with the floating rails.

Accordingly, there is a long felt need for a very stable mount for two or more rails, and it would be very desirable to have such a mount which permits the mounting of six rails on a single weapon and which can be assembled easily by the user of the firearm.

SUMMARY OF THE INVENTION

The present invention provides a rail connector for a firearm which provides stable alignment over time, during firing of the weapon or even if the weapon receives a shock, thereby substantially maintaining the alignment of various accessories mounted on the weapon over time. According to one embodiment of the invention, six separate rails are provided on the mount.

There is thus provided, is accordance with the present invention, a connector for mounting on a firearm having a front sight, the connector including at least two accessory rails, and a fastening member for securely fastening the connector directly to the front sight of the firearm, the fastening member being coupled to the rails.

According to a preferred embodiment, the fastening member is shaped to seat securely in the front sight.

According to one embodiment of the invention for use on the AR15 platform based family of firearms, the sight includes a triangular projection defining a triangular aperture with a depending shoulder therethrough, and the connector includes a shaped protrusion for seating in the aperture against the shoulder, and a protruding lip for lockingly engaging a lower leg of the triangular projection.

According to one embodiment of the invention, the connector includes two half portions, each including a rail integrally formed with one half the fastening member, the half portions being adapted to seat on opposite sides of the sight and be connected to one another. The two rails may be formed coaxially in alignment with the fastening member, or displaced from and parallel to a longitudinal axis of the fastening member.

According to an alternative embodiment of the invention, the connector includes a handguard integrally formed with four rails, the handguard preferably being integrally formed with the fastening member, and further including a circumferential ring arranged to engage a toothed wheel mounted about the firearm barrel. Preferably, the connector is formed of two mating units, each including one half of the handguard, and arranged for mating fit around the barrel of a firearm.

According to yet another embodiment of the invention, the connector includes two pivotally connected legs, each leg ending in one fastening member. Preferably, the legs, when in a closed orientation, form an accessory rail arranged to seat above the barrel of the firearm.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to connectors for mounting a plurality of rails, such as Picatinny rails according to MIL-STD-1913, or other mounting rails, on a rifle or other firearm, in a secure fashion which substantially maintains alignment of accessories mounted thereon over time. This is accomplished by affixing the connector directly to the front sight of the weapon. The invention is particularly suitable for use on the P-90 sub-machine gun of FN Herstal, SA, Herstal, Belgium, the Galil of Israel Military Industries, of Ramat Hasharon, Israel, and the family of AR15 platform based weapons (e.g., M-16, AR15, A4), manufactured and sold by Colt Defense LLC, Connecticut, USA, and AK-47 (Automat Kalashnikova, Model 1947).

It is a particular feature of the invention that the connector is mounted on the front sight as it is, without requiring removal, dismantling, or otherwise changing the sight or any other armor work. Thus, a soldier can mount the connector by himself, without requiring any factory adjustments or mounting.

Figure 1:
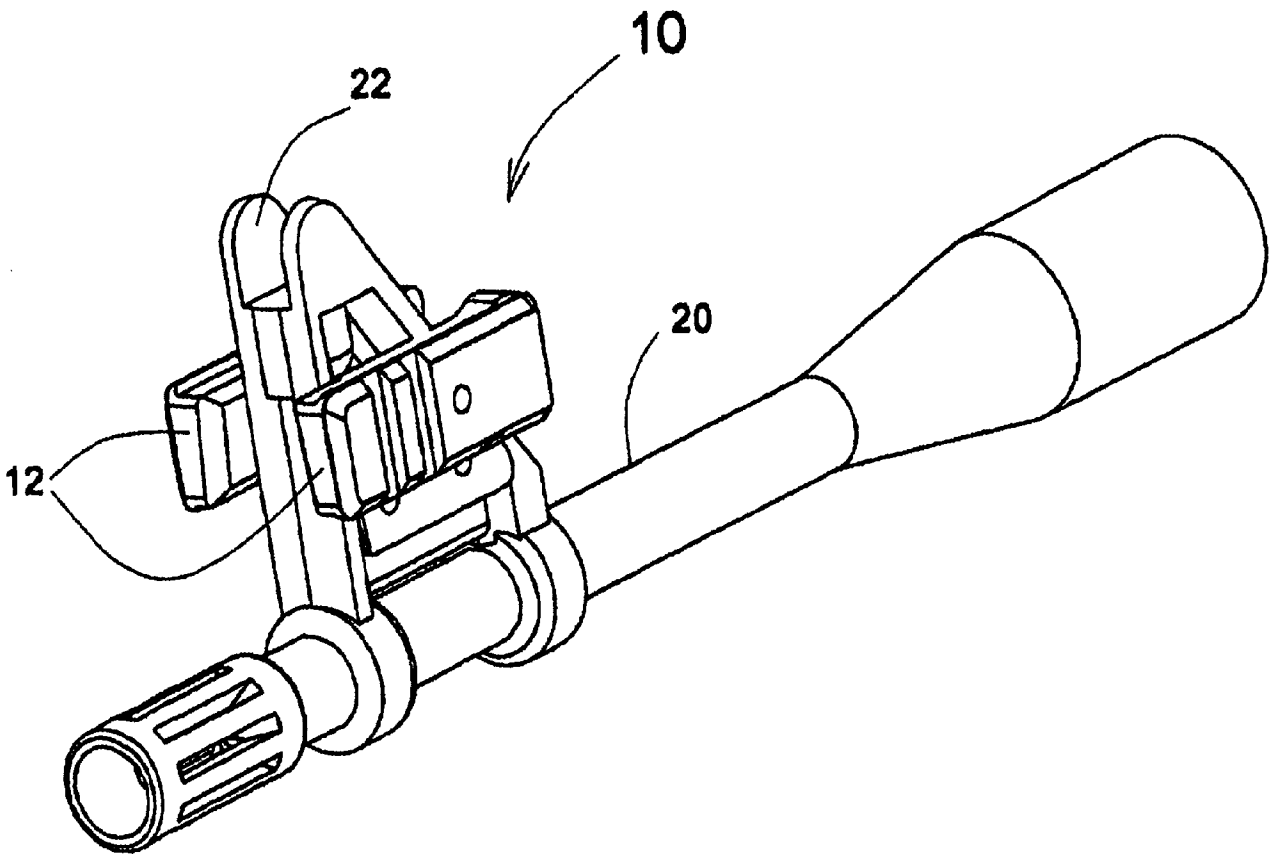
FIG. 1 is a perspective view of a rail connector constructed and operative in accordance with one embodiment of the present invention mounted on the front part of a firearm from the AR15 platform family.
Figure 2A:
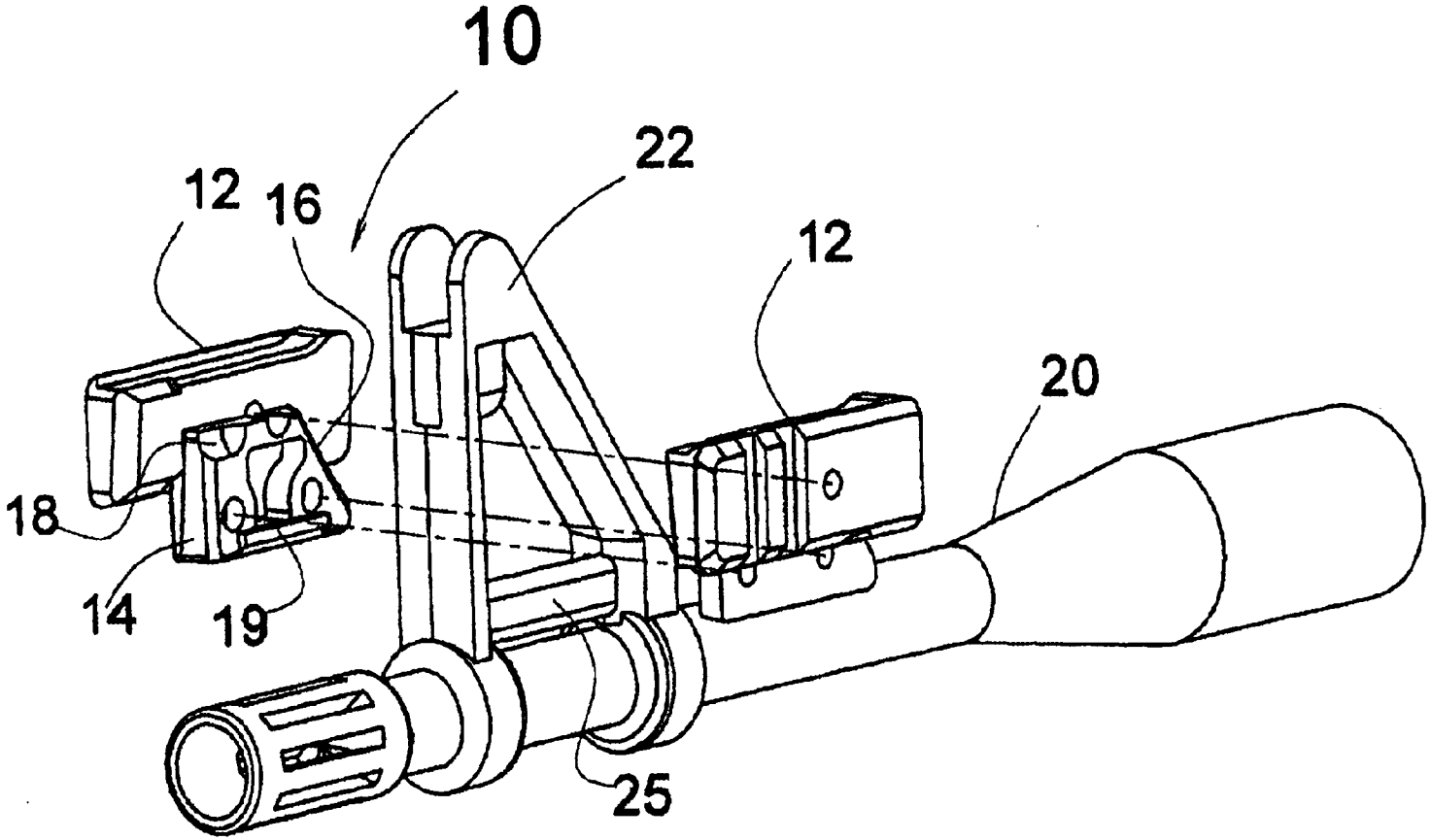
FIG. 2*a* is an exploded view of the rail connector of FIG. 1.

Referring now to FIGS. 1 and 2*a*, there are shown respective perspective and exploded views of a rail connector 10 constructed and operative in accordance with one embodiment of the present invention. Rail connector 10 is adapted for mounting on the barrel 20 of a firearm having a front sight 22, and includes at least two accessory rails 12, and a member 14 for securely fastening the connector directly to the front sight 22 of the firearm.

In this embodiment, the two rails 12 are displaced from and parallel to a longitudinal axis of the fastening member 14. The mounting rails can be of any suitable shape and size, but preferably are Weaver or Picatinny rails, conforming to MIL-STD-1913 and MIL-STD-1913 Update Notice.

Figure 2B:
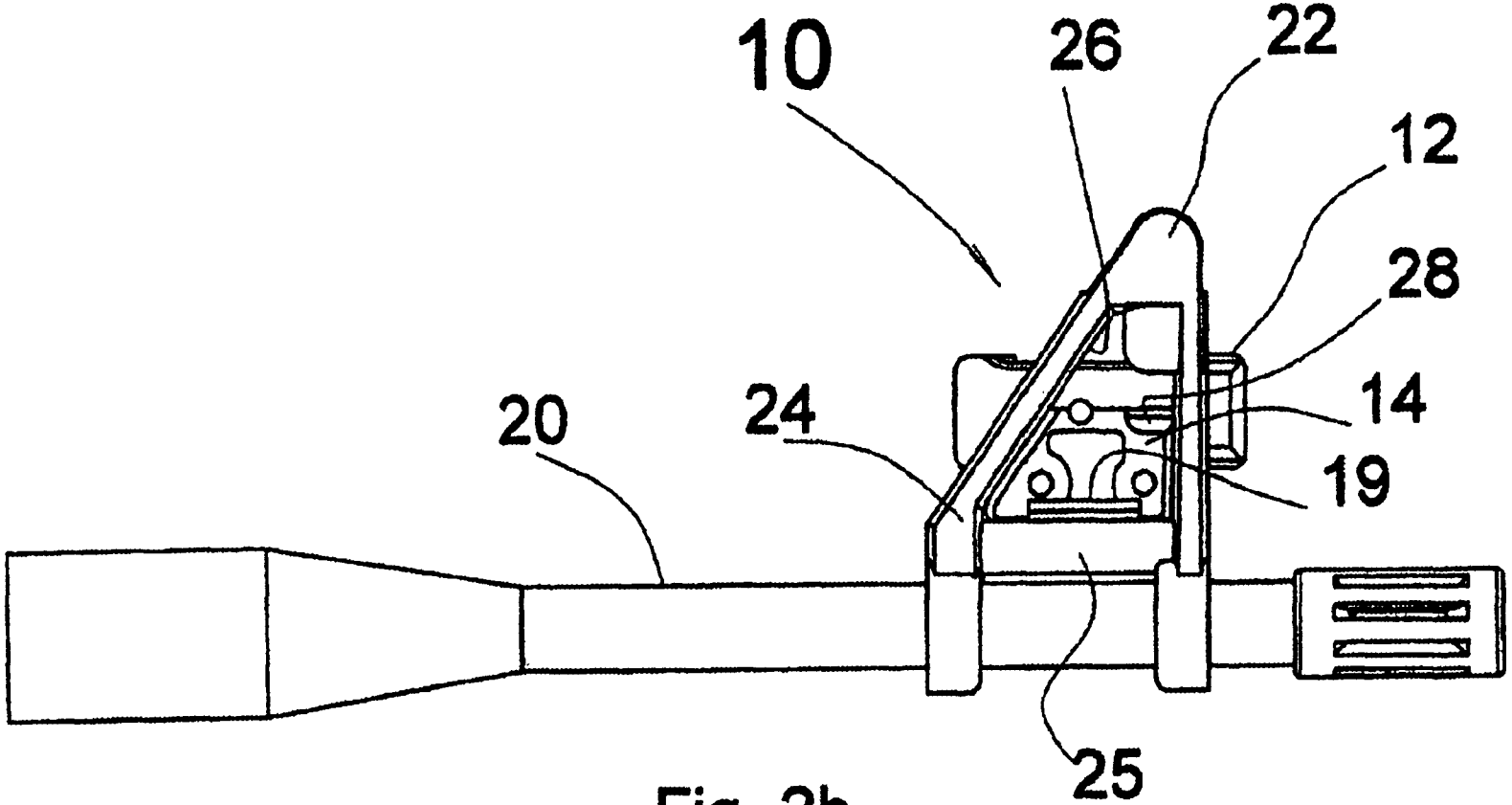
FIG. 2*b* is a side view of one half of the rail connector of FIG. 1 as seated in a front sight.

As can be seen most clearly in FIG. 2*b*, in the illustrated embodiment for use with the AR-15 family of firearms, sight 22 includes a substantially triangular frame 24 defining a triangular aperture 26 with a depending shoulder 28 therein. The fastening member 14 of connector 10, as seen in FIGS. 2*a* and 2*b*, is a shaped protrusion including a sloping wall 16 for seating in aperture 26 and a depression 18 for abutting against the shoulder 28. Fastening member 14 also includes a protruding lip 19 for lockingly engaging the lower leg 25 of the triangular frame 24. In this preferred embodiment, each rail 12 is integrally formed with one half of the fastening member 14, the two halves being coupled about the sight 22, as by screws or bolts. In this way, each side of the rail connector is a mirror image of the other. Alternatively, the fastening member can be integrally formed with one rail and, after seating through the front sight of the weapon, the second rail can be coupled to the fastening member, as by bolts.

It is a particular feature of the invention that the fastening member is shaped to be affixed securely to the front sight. Thus, the shape of the fastening member will differ according to the shape of the front sight of the particular firearm. In the illustrated embodiment of the present invention, the fastening member is shaped to seat securely in the original aperture of the front sight 22. Thus, in weapons with front sights which are shaped differently from that in FIG. 2, the locking member will be of the appropriate shape to securely seat in or couple to the sight.

Figure 3:
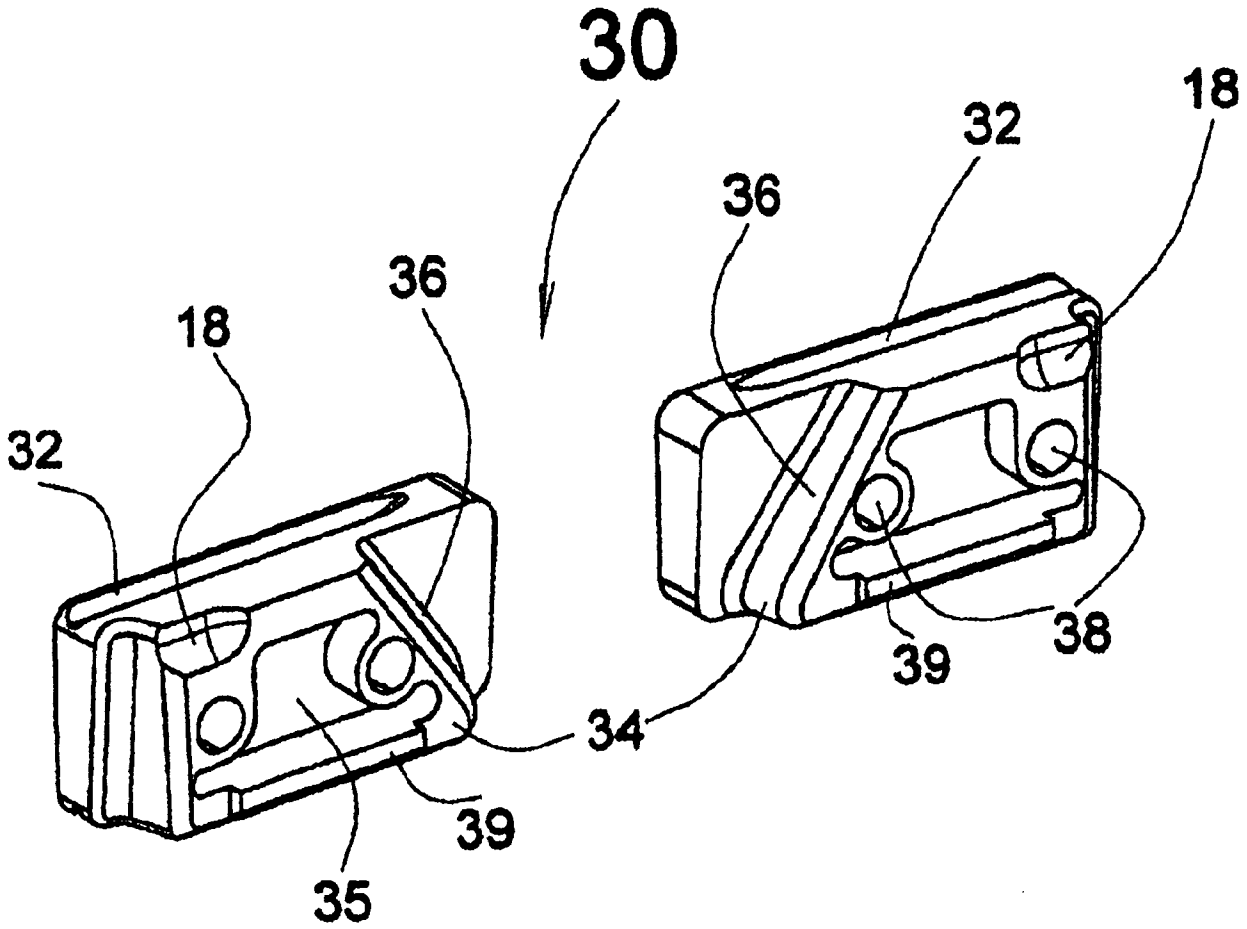
FIG. 3 is a plan view of two halves of a rail connector constructed and operative in accordance with another embodiment of the present invention.

According to an alternative embodiment of the invention, shown in plan view in FIG. 3, the rail connector 30 includes two rails 32 formed coaxially in alignment with the fastening member 34. In FIG. 3, as well, each rail 32 is coupled to one half of the fastening member 34 which are seated on opposite sides of the front sight of the weapon and coupled to one another. The fastening member of this embodiment is similar to that shown in FIG. 1, and includes a shaped protrusion including a sloping wall 36 and a depression 38 for seating in the aperture in the front sight and abutting against the shoulder in the sight. Fastening member 34 also includes a protruding lip 39 for lockingly engaging the sight. According to one embodiment of the invention, the fastening member includes a hollowed out portion 35, to reduce the material required to form the connector and to reduce its weight.

Figure 4A:
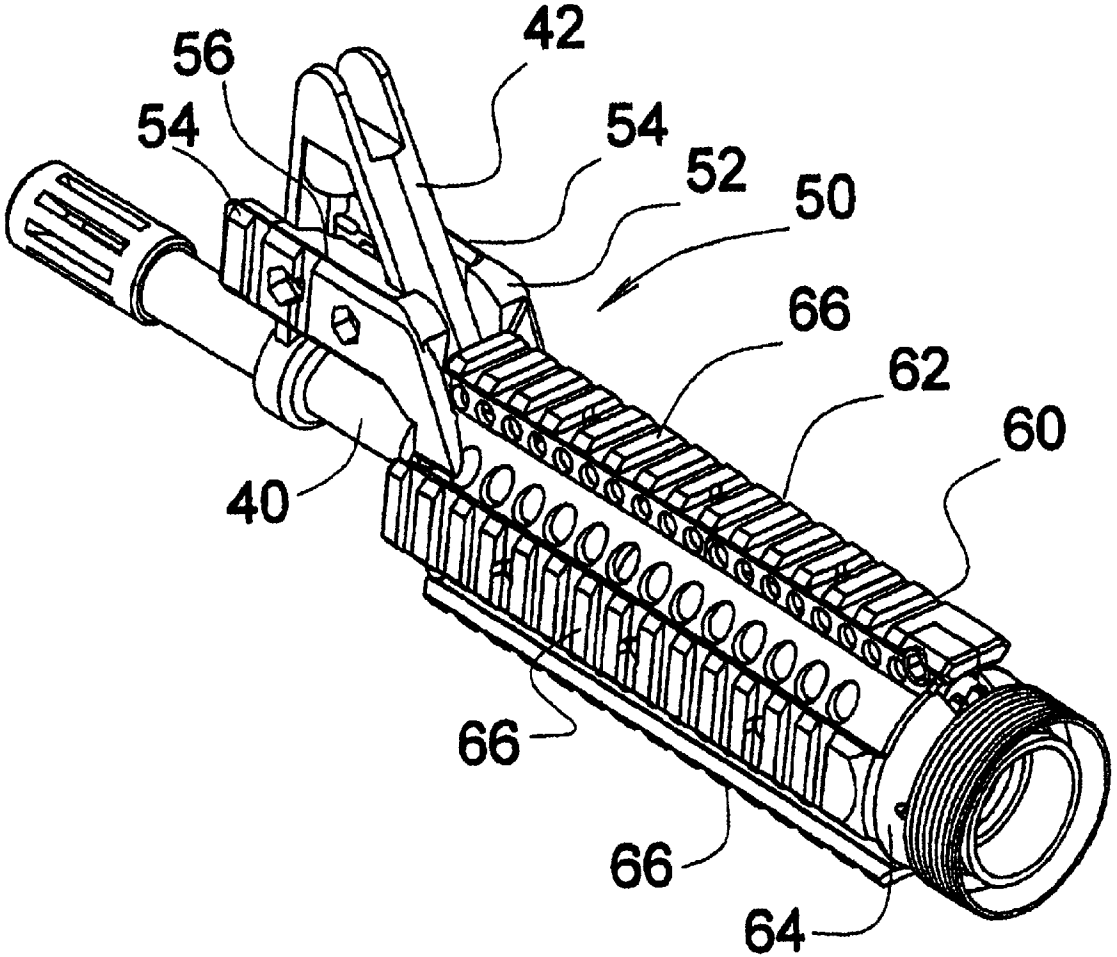
FIG. 4*a* is a perspective view of a rail connector constructed and operative in accordance with a further embodiment of the present invention mounted on a barrel.
Figure 4B:
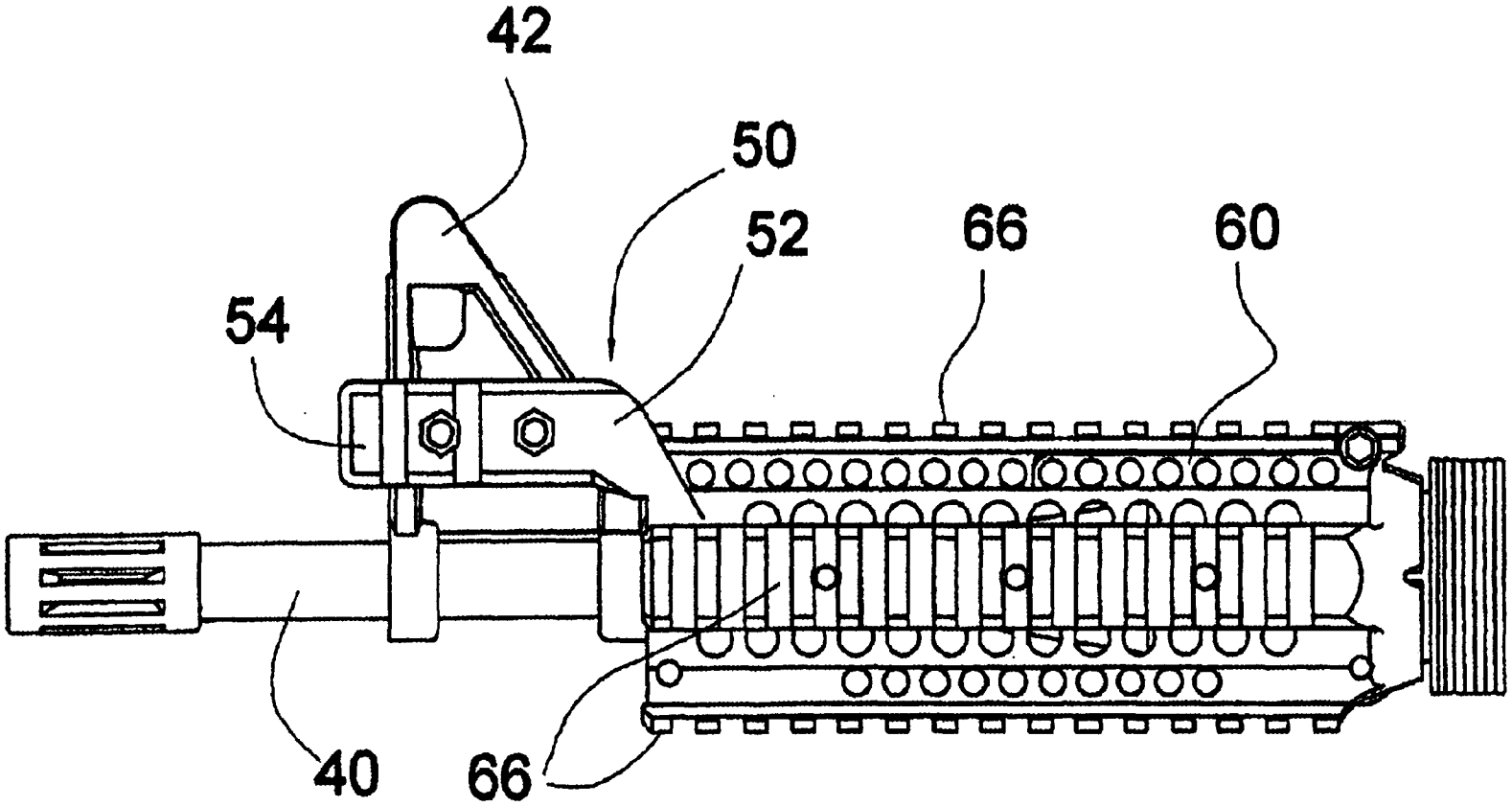
FIG. 4*b* is a side view of the rail connector of FIG. 4*a;*
Figure 4C:
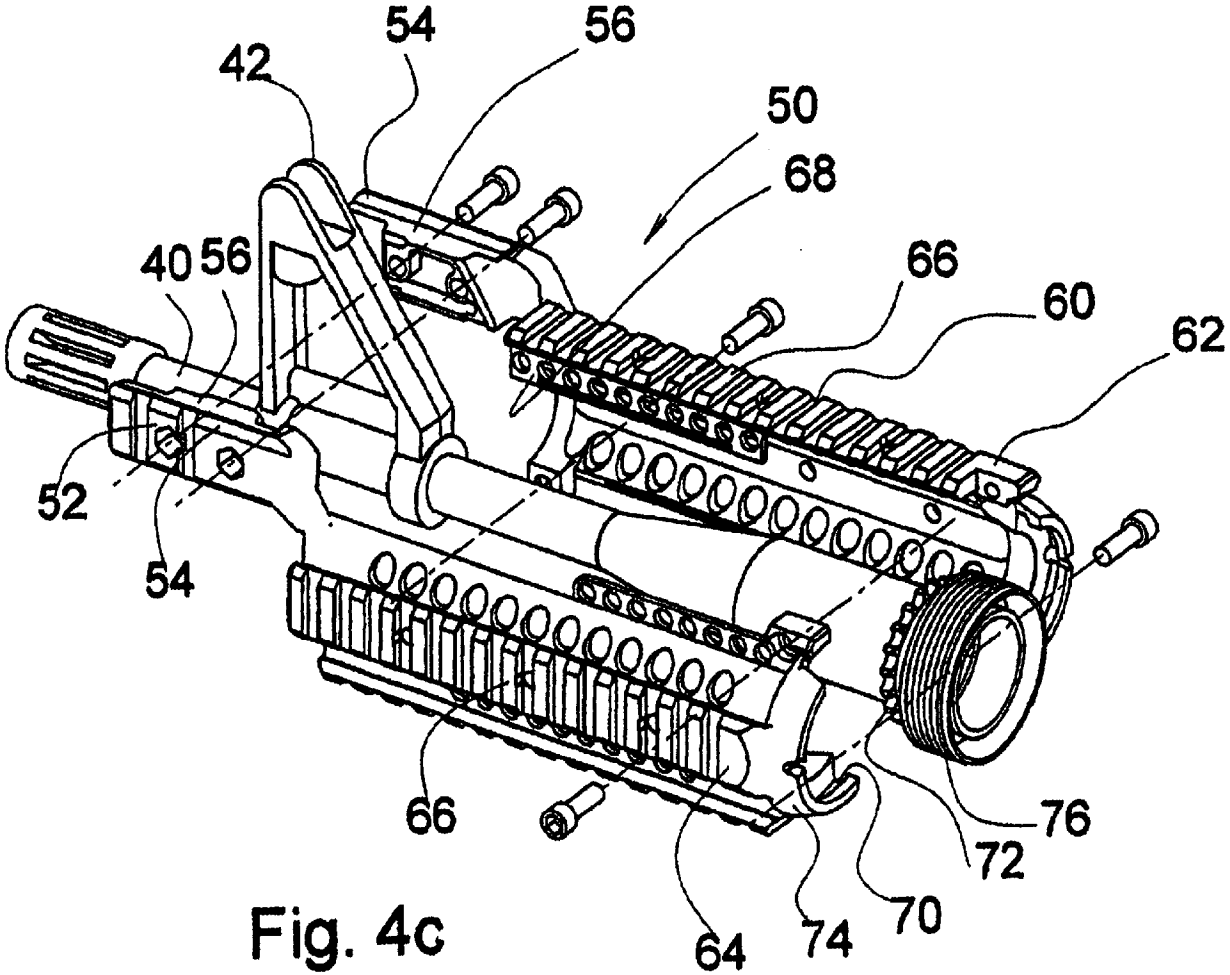
FIG. 4*c* is an exploded view of the rail connector of FIG. 4*a;*
Figure 5A:
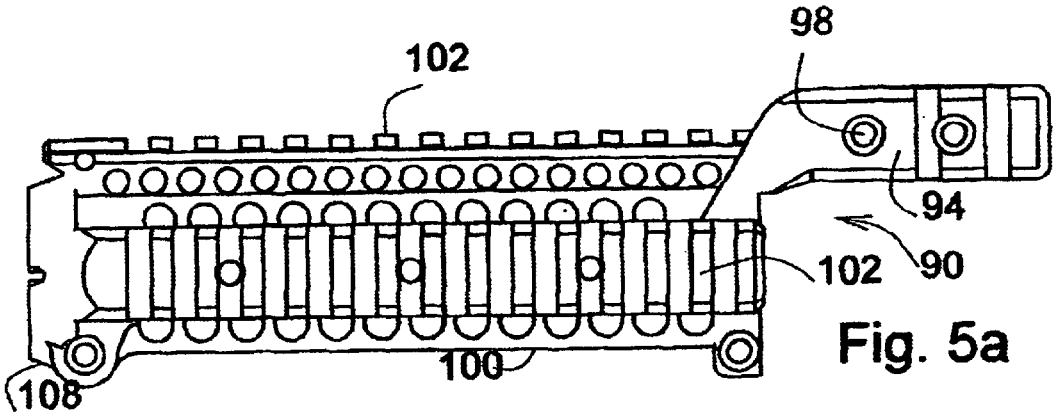
FIGS. 5*a*, 5*b*, 5*c*, and 5*d* are respective outside, top, inside, and bottom of one half of a rail connector constructed and operative in accordance with another embodiment of the invention.
Figure 5B:
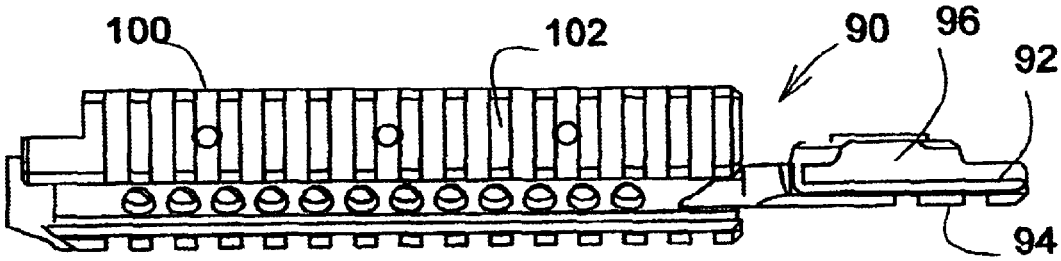
Figure 5C:
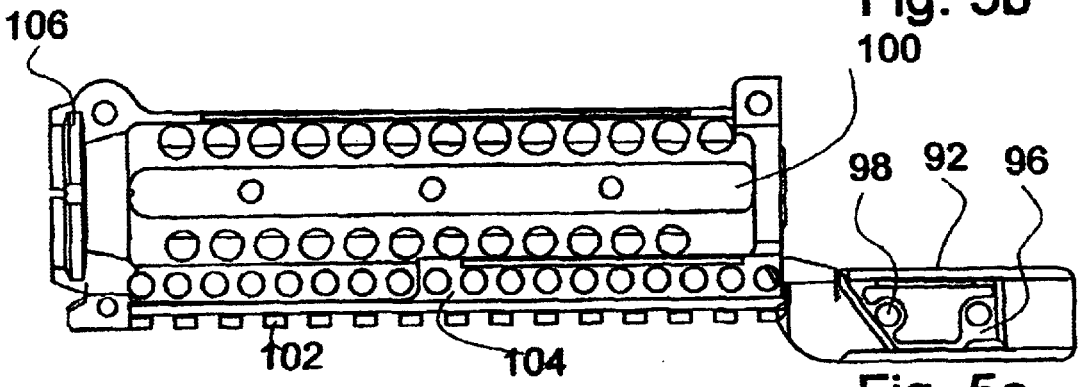
Figure 5D:
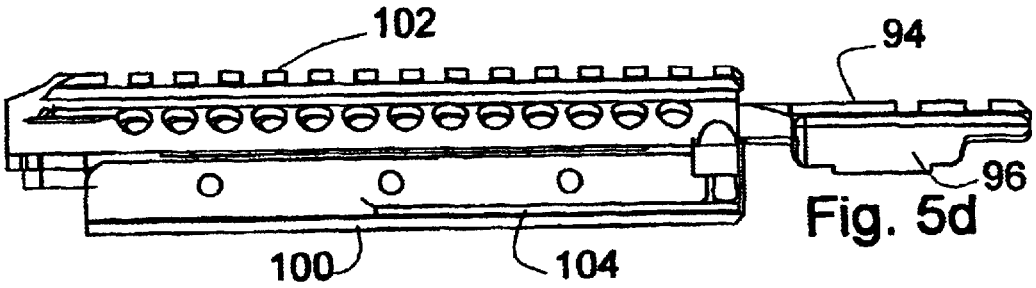
Figure 6A:
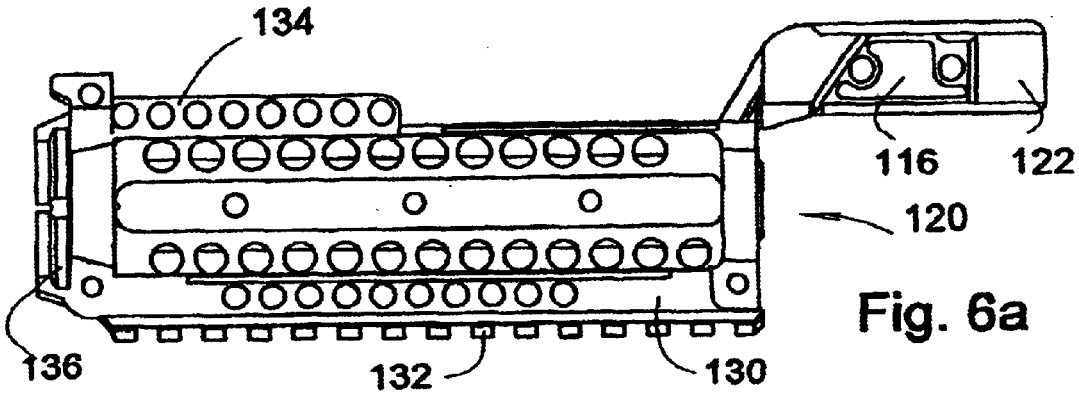
FIGS. 6*a*, 6*b*, 6*c*, and 6*d* are respective inside, top, outside, and bottom of the mating half of the rail connector of FIGS. 5*a* to 5*d;*
Figure 6B:
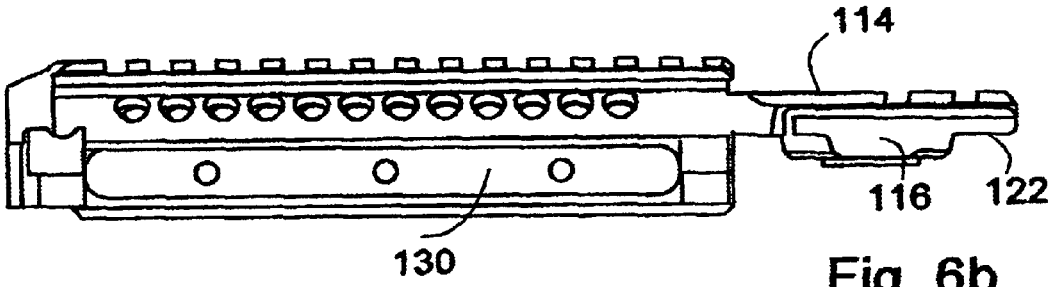
Figure 6C:
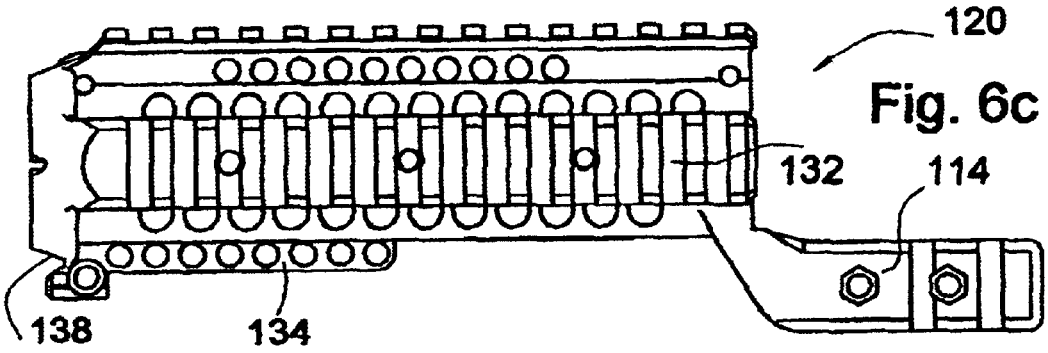
Figure 6D:
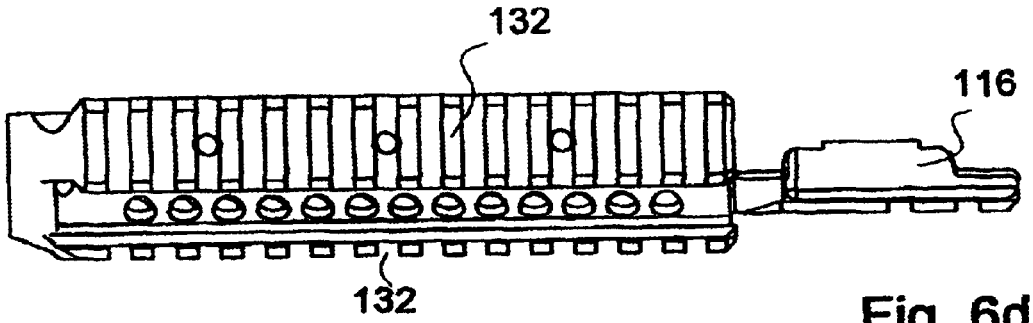

Referring now to FIGS. 4*a*, 4*b*, and 4*c* there are shown respective perspective, side and exploded views of a rail connector 50, constructed and operative in accordance with a further embodiment of the present invention, mounted on a barrel 40 having a front sight 42. In this embodiment, front sight 42 is a substantially triangular, hollow sight. Rail connector 50 includes an integrally formed handguard, thereby providing a single unit which includes six mounting rails, a feature which does not exist at present. Thus, two rails are provided on the connector portion, itself, and four rails are provided on the hand guard portion.

It is a particular feature of this embodiment that the connector, thus, provides mounting for a number of accessories, simultaneously, which do not need to be zeroed repeatedly, as the alignment is substantially unchanging during firing or if the weapon receives a shock. According to a preferred embodiment of the invention, illustrated in FIG. 4*c*, the connector is formed of two mating units, each including one half of the handguard 60, and arranged for mating fit around the barrel and gas tube of a firearm.

Rail connector 50 includes a connector portion 52, which can be substantially similar to rail connector 30 shown in FIG. 3, and a handguard portion 60. Connector portion 52 includes two rails 54 and a fastening member 56 shaped to seat inside the hollow sight 42. According to the illustrated embodiment, connector portion 52 is formed of two mirror image units, each including one half of the fastening member 56. Alternatively, the connector portion can include one rail coupled to, or preferably, integrally formed with a fastening member extending from side to side of the sight, and arranged to be coupled directly to a second rail.

Handguard portion 60 preferably includes two mating portions 62, 64 which are coupled, as by screws or bolts, around the barrel. Most preferably, the handguard portion 60 includes four integrally formed mounting rails 66, such as Picatinny rails, and complementary joining elements 68, 69 to permit assembly of the rail connector about the gas tube of the firearm. Preferably, the handguard portion includes a circumferential groove 70 arranged to engage a toothed barrel nut 72 about the firearm barrel, and a tapered end 74 arranged to be engaged by a Delta ring 76, for maintaining the hand guard in an anchored orientation on the barrel. It will be appreciated that, provided there is sufficient space, any number of rails may be mounted on the handguard.

It will be appreciated that different firearms have different elements for mounting and anchoring their handguards about the barrel. The rail connector of the present invention preferably will be adapted to be anchored by the specific elements found on the firearm with which it is to be used.

FIGS. 5*a*, 5*b*, 5*c*, and 5*d* are respective outside, top, inside, and bottom of one half of a rail connector 90 constructed and operative in accordance with one embodiment of the invention, suitable for mounting on any of the AR15 platform family members. Rail connector 90 includes a connector portion 92 integrally formed with a handguard portion 100. Connector portion 92 includes two rails 94 and a fastening member 96 shaped to seat inside the hollow sight of the firearm. Screw holes 98 may be provided for coupling one half of the rail connector to another on opposite sides of the front sight of the firearm.

Handguard portion 100 is one of two mating portions which are coupled, as by screws or bolts, around the barrel. For use with the M16 family of weapons, the handguard portion 100 includes two integrally formed mounting rails 102, such as Picatinny or Weaver rails. One face of the handguard portion may be cut to provide a pair of complementary elements 104 designed to permit assembly of the handguard portion about the gas tube of the firearm. In this embodiment, handguard portion 100 further includes a circumferential groove 106 arranged to engage a toothed barrel nut on the firearm barrel, and may include a tapered end 108 arranged to sit inside a Delta ring, also on the barrel, so as to provide a rear anchor for the handguard.

FIGS. 6*a*, 6*b*, 6*c*, and 6*d* are respective inside, top, outside, and bottom of the complementary half 120 of the rail connector of FIGS. 5*a*–5*d*. This half also includes a connector portion 122 integrally formed with a handguard portion 130. Connector portion 122 includes two rails 114 and a fastening member 116 shaped to seat inside the hollow sight of a firearm and be coupled to fastening member 96 of connector portion 92 as by screws.

Handguard portion 130 is the complementary portion of handguard portion 100, and is arranged to be coupled thereto, as by screws or bolts, around the barrel. In this embodiment, handguard portion 130 also includes two integrally formed mounting rails 132, such as Picatinny rails, and the second complementary joining element 134 arranged to provide a tight fit when coupled together. Handguard portion 130 may further include a circumferential groove 136 arranged to engage a toothed barrel nut on the firearm barrel, and a tapered end 138 arranged to be engaged by a Delta ring, when assembled about the barrel of a firearm based on the AR-15 platform.

Figure 7:
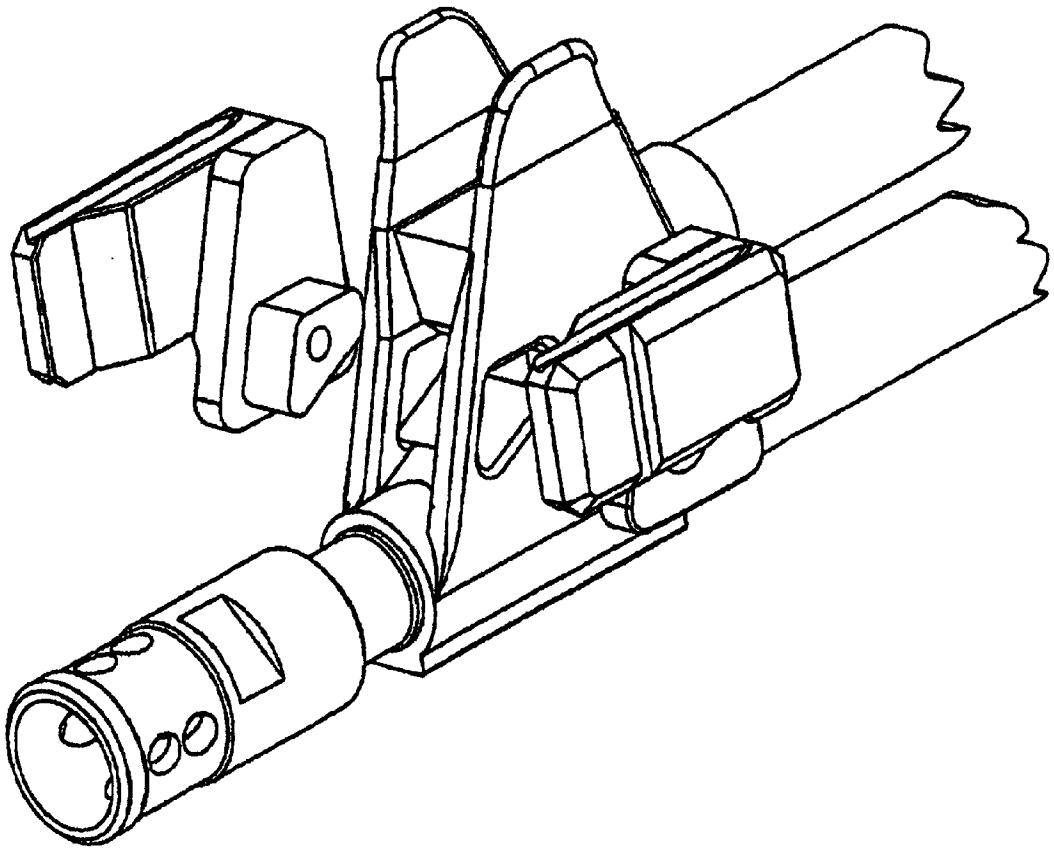
FIG. 7 is a schematic perspective view of a rail connector constructed and operative in accordance with a further embodiment of the present invention suited for the Galil family of weapons.
Figure 8:
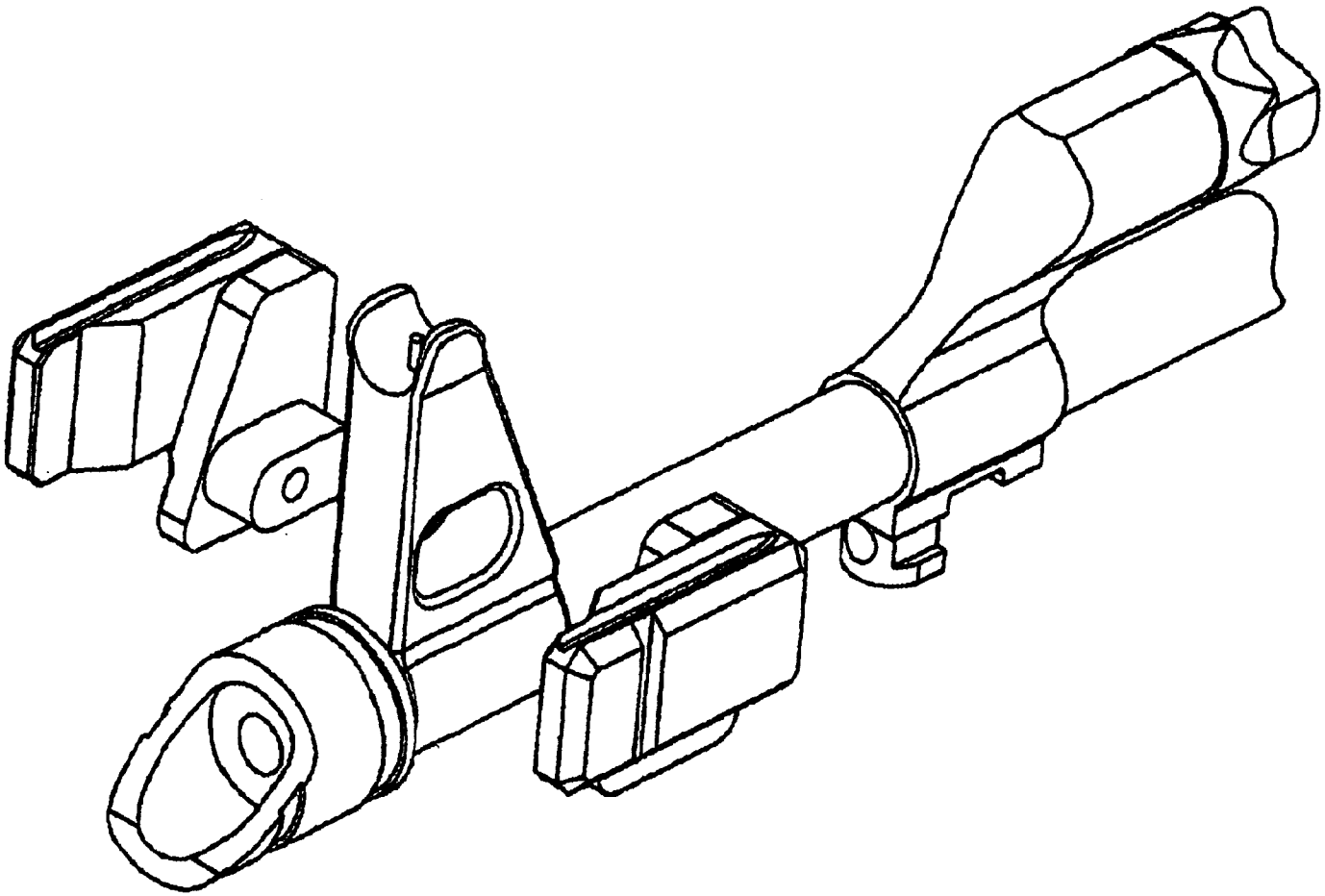
FIG. 8 is a schematic perspective view of a rail connector constructed and operative in accordance with another embodiment of the present invention suited for the AK-47 family of weapons.

It will be appreciated that different firearms have front sights having different shapes. Accordingly, the rail connector of the present invention will include a fastening member and connector portion shaped to fit the front sight of the particular weapon on which it is to be mounted. As non-limiting examples only, there is shown, in FIG. 7, a schematic perspective view of a rail connector suited for the Galil family of weapons and, in FIG. 8, a schematic perspective view of a rail connector suited for the AK-47 family of weapons.

Figure 9:
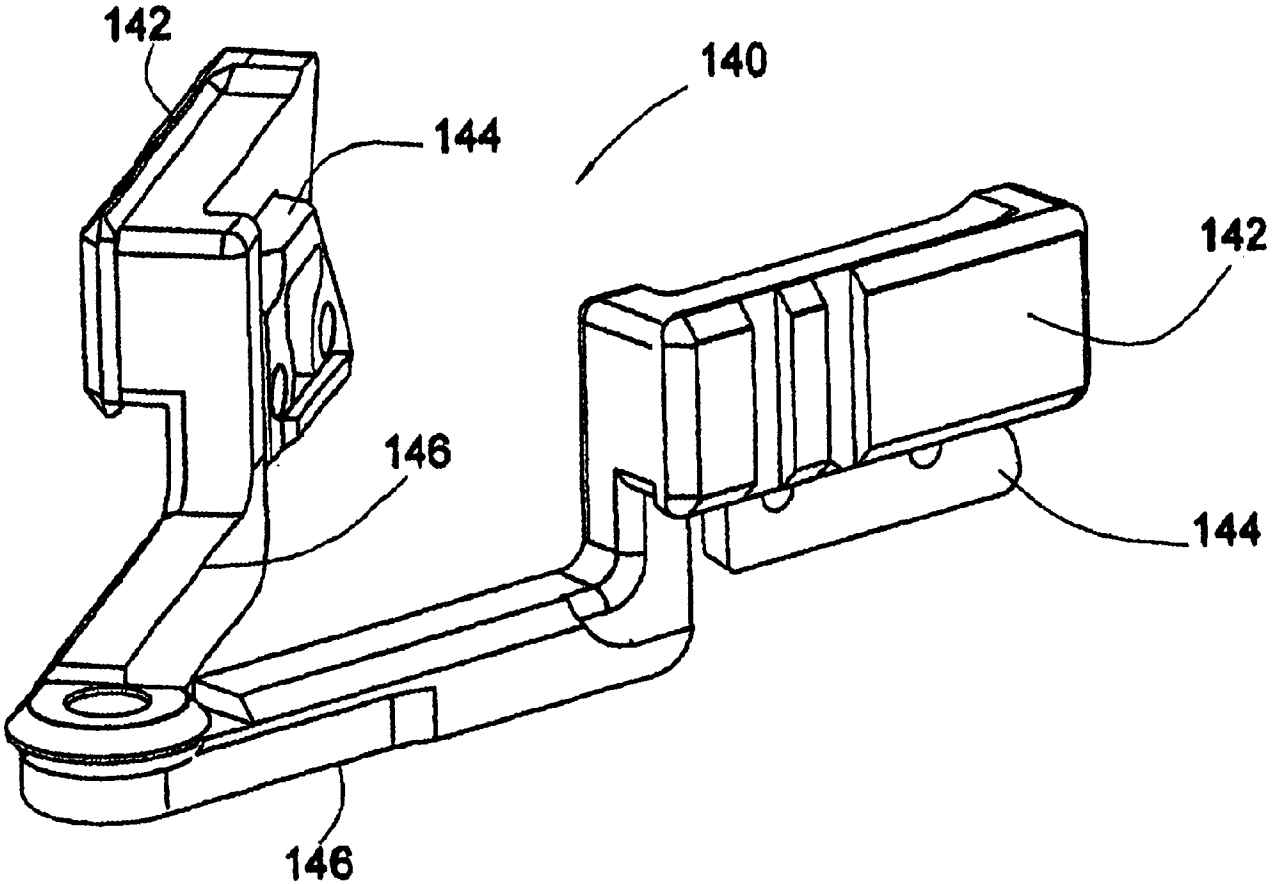
FIG. 9 is a schematic perspective view of a rail connector constructed and operative in accordance with yet another embodiment of the present invention in an open orientation.
Figure 10:
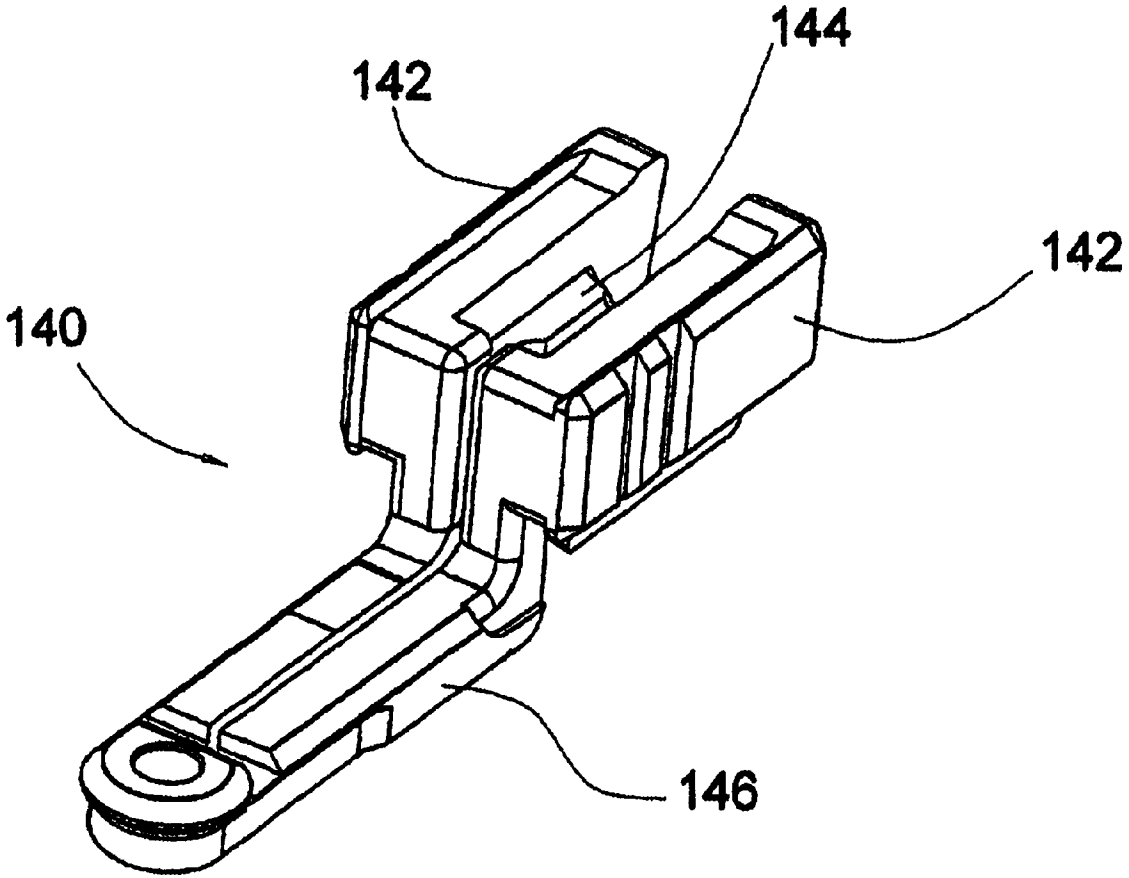
FIG. 10 is a perspective view of the rail connector of FIG. 9 in a closed orientation.
Figure 11:
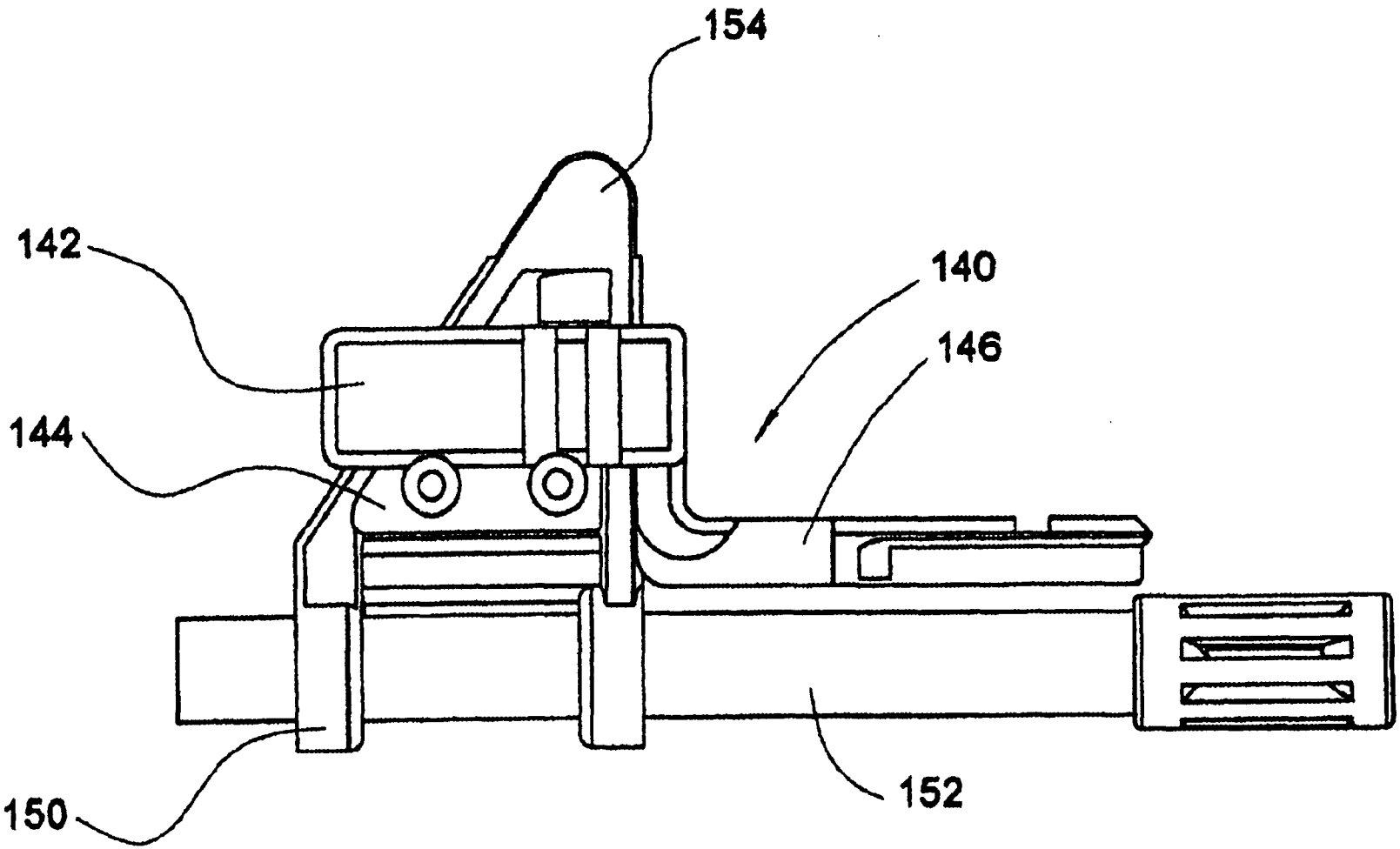
FIG. 11 is a side view of the rail connector of FIG. 9 when mounted on the barrel of a firearm.

Referring now to FIGS. 9, 10 and 11, there are shown respective schematic perspective and side views of a rail connector 140 constructed and operative in accordance with yet another embodiment of the present invention. In this embodiment, rail connector 140 is adapted to seat above the barrel 152 of a firearm 150 having a front sight 154. Rail connector 140 includes two accessory rails 142 integrally formed with a member 144 for securely fastening the connector directly to the front sight 154 of the firearm, which merge into two pivotally connected legs 146. When it is desired to couple the rail connector to a firearm, the legs 46 are opened, as shown in FIG. 9, and then closed with fastening members 144 engaging the front sight, as described above. Preferably, when in the closed orientation, shown in FIG. 10, the legs 146 define an additional mounting rail for accepting an accessory for mounting forward of the front sight 154.

It will be appreciated that the invention is not limited to what has been described hereinabove merely by way of example. Rather, the invention is limited solely by the claims which follow.

What is claimed is:

1. A rail connector for mounting on a firearm having a front sight, said connector comprising:

at least two mounting rails; and a fastening member for securely fastening the connector directly to the front sight of said firearm, said fastening member being coupled to said mounting rails;

wherein said the fastening member is shaped to seat securely in an aperture defined by the front sight or coupled to said front sight.

2. The rail connector according to claim 1, wherein:

the sight includes a triangular projection defining a triangular aperture with a depending shoulder therethrough, and the fastening member includes a shaped protrusion for seating in the aperture against the shoulder, and a protruding lip for lockingly engaging a lower leg of the triangular projection.

3. The rail connector according to claim 1, wherein the connector includes two half portions, each including a rail integrally formed with one half the fastening member, the half portions being adapted to seat on opposite sides of the sight and be connected to one another.

4. The rail connector according to claim 3, wherein the two rails are formed coaxially in alignment with the fastening member.

5. The rail connector according to claim 3, wherein the two rails are displaced from and parallel to a longitudinal axis of the fastening member.

6. The rail connector according to claim 1, wherein the fastening member is integrally formed with one rail and is arranged to be coupled to a second rail from an opposite side of the sight, after seating through one side of the front sight of the weapon.

7. The rail connector according to claim 3, and further including a handguard portion integrally formed with the fastening member and integrally formed with at least one rail.

8. The rail connector according to claim 7, and including four rails integrally formed with said handguard portion.

9. The rail connector according to claim 7 and further including a circumferential groove arranged to engage a toothed barrel nut about the firearm barrel.

10. The connector according to claim 7, wherein the handguard is formed of two mating units, each including one half of the handguard, and arranged for mating fit around the barrel of a firearm.

11. The rail connector according to claim 1, wherein said fastening members merge into two pivotally connected legs.

12. The rail connector according to claim 11, wherein said legs, when in a closed orientation, form an accessory rail arranged to seat above a barrel of the firearm.

13. The rail connector according to claim 1, wherein said fastening member is shaped to seat securely in an aperture defined by said front sight.

14. The rail connector according to claim 1, wherein said fastening member is coupled to said front sight.

15. The rail connector according to claim 1, wherein six mounting rails are coupled to said fastening member.

16. The rail connector according to claim 13, further comprising a handguard portion integrally formed with said fastening member and arranged for mounting about the barrel of said firearm, wherein four of said six mounting rails are integrally formed with said handguard portion.

* * * * *